US005092586A

United States Patent [19]

Tuthill et al.

[11] Patent Number: 5,092,586

[45] Date of Patent: Mar. 3, 1992

[54] DISK EXERCISER FOR IMPROVING BALANCING SKILLS

[76] Inventors: Gary E. Tuthill, 1840 N. Carlsbad, Orange, Calif. 92667; Robert S. Smith, 1263 Emory St., San Jose, Calif. 95126

[21] Appl. No.: 591,609

[22] Filed: Oct. 2, 1990

Related U.S. Application Data

[63] Continuation-in-part of Ser. No. 405,314, Sep. 11, 1989, abandoned.

[51] Int. Cl.[5] ..... A63B 23/04

[52] U.S. Cl. ..... 272/111; 272/146

[58] Field of Search ..... 272/111, 124, 146, 93; 33/27.05, 836; 73/65

[56] References Cited

U.S. PATENT DOCUMENTS 1,565,484 12/1925 McWhirter ..... 272/111
4,759,542 7/1988 Hudec .
4,819,935 4/1989 Dirksing et al. ..... 272/124

FOREIGN PATENT DOCUMENTS 2288539 5/1976 France ..... 272/146
0528273 11/1972 Switzerland ..... 272/146

*Primary Examiner*—Stephen R. Crow
*Attorney, Agent, or Firm*—Robert Samuel Smith

[57] ABSTRACT

An apparatus for improving balancing skill which comprises a disk with threaded hole in its center and a threaded rod screwed through the threaded hole. The user stands on the disk and attempts to maintain the disk in a horizontal position, i.e., balance himself on the disk and supported on the rod. Difficulty of maintaining balance is proportional to the distance from the contact point with the floor to the hole in the center of the disk. This distance is indicated for a given position of the rod by indicia imprinted on the side of the rod. The indicia therefore gives the user the opportunity to measure the difficulty of performing the exercise and to vary the difficulty by a controlled increment.

4 Claims, 2 Drawing Sheets

FIG. 1
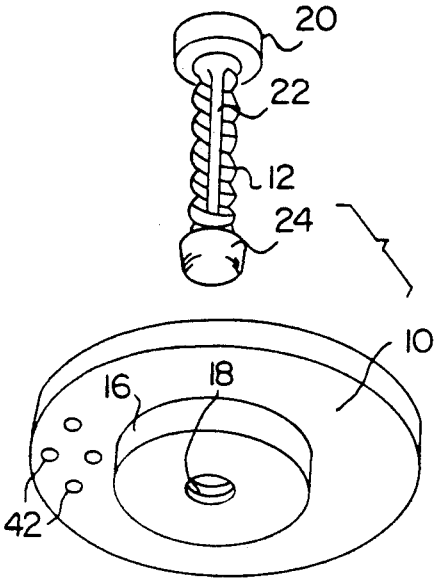
FIG. 2
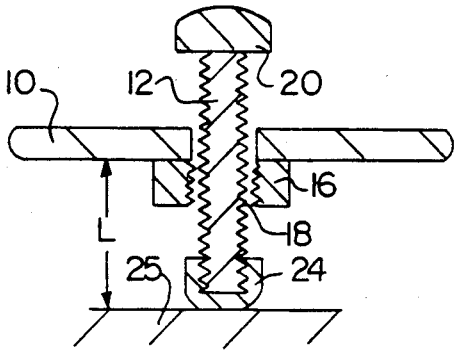
FIG. 4
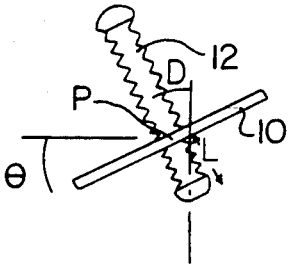
FIG. 5
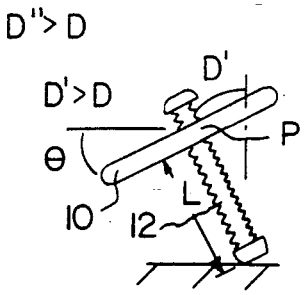
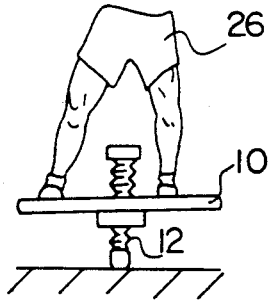
FIG. 3
FIG. 6
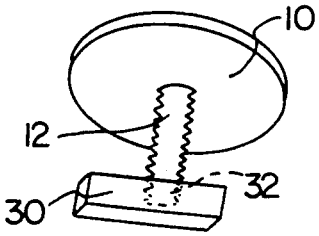

DISK EXERCISER FOR IMPROVING BALANCING SKILLS

CROSS REFERENCE TO OTHER PATENT APPLICATIONS

This application is a continuation-in-part of an application having Ser. No. 405,314 filed Sept. 11, 1989, and currently copending, abandoned Nov. 19, 1990.

FIELD OF THE INVENTION

This invention relates to an apparatus and method for rehabilitating or training a user to improve his motor skills used in athletics, child development, and for performing exercises bgy invalids, older people, etc., that promote development of the proprioceptors.

PRIOR ART

The human body has three kinds of sense organs. One kind are the exteroceptors which enable the body to become conscious of stimuli that originate outside the body—sight, sound, smell, touch. A second kind are the interoceptors which are found in the mucous lining of the respiratory and digestive tracts and which enable the body to be conscious of activities inside the body such as the sensation of swallowing food, taking a breath, etc. A third kind are the proprioceptors which enable the body to maintain balance, develop motor skills, etc.

The proprioceptors are located in skeletal muscle, tendons, blood vessels, and the gastrointestinal wall. A muscle proprioceptor comprises the end of a sensory nerve wrapped around a muscle fiber and detects expansion and contraction of the enclosed muscle fibers that transmit appropriate messages to the brain.

The proprioceptor sends information to the central nervous system concerning the position of the arms and legs in relation to their surroundings.

Proprioceptors develop by training but, once trained, they function on a subconscious level. For example, a baby has to make a conscious effort to lift his spoon to his mouth but once this simple motor skill has been developed, this task is performed subconsciously for the rest of his life.

Proprioceptors respond to vibration, positions, movement, pressure, weight and touch. Proprioceptive learning has been found to play an important role in strength increases associated with strength development programs. If a muscle is tested in an unaccustomed position, the strength of the muscle is diminished even though the angle of muscular pull is carefully standardized.

Proprioceptive training has been incorporated into the regimen of physical routines of complex motions known as PNF TECHNIQUE (proprioceptive neuromuscular facilitation). Conventional methods of development can include rope skipping, horseback riding, beam balancing, simple gymnastics, etc.)

A number of balancing boards are on the market for practicing balancing skill.

One balance board, called the "BAPS" board, comprises a disk (generally wooden) that has a flat side of a hemisphere attached to the underside of the disk and is concentric with the disk. The user attempts to balance himself standing on the disk using the hemisphere as a fulcrum. Various sizes of hemispheres may be attached to the board in order to vary the difficulty of balancing the disk however this construction does not provide the fine degree of variation in difficulty of balancing that provides for progressive improvement. Other inconveniences with this construction is having to keep track of a number of hemispheres and replacing one for another.

Another balance board is a disk with a hole (about three inches diameter) in its center. A ball (four inches dia.) is placed partially into the hole so that the ball functions as a fulcrum when the ball and disk are placed on the floor. The user stands on the disk and attempts to balance the disk, i.e., maintain the disk in a horizontal position.

Another balance board is similar in construction to the board described in the previous paragraph except that a weight arrangement near the perimeter of the disk provides resistance to turning the ankle and is therefore useful for strengthening the ankle.

PNF regimen is selected depending on the many purposes for which the routines are intended. These can include early stages of child development, conditioning for seniors of most any age, athletes in intensive training in all sports and rehabilitation following injury.

The PNF techniques that are applied by the prior art are generally of a random non-quatitative character in comparison with other forms of exercise. For example, weightlifting has a quantitative character because a lifter can measure his improvement by the amount of weight he can lift, a runner can measure his time to turn a distance, etc. There are some PNF exercises that can be measured quantitatively. For example, one can measure his skill in shooting a basketball, bowling or throwing at a target.

However, the prior art does not address the problem of measuring the difficulty of balancing together with controlling the difficulty of balance. Measurement of progress related to control of difficulty is an essential feature of any apparatus and method used to develop an athletic skill.

An example of devices requiring balancing skill, French Patent 2288-539 to Lecal is for a > "rocking horse type of toy with seat adjustable on a column with disk movable along the column to vary rocking angle and engaging the ground."

Aside from the fact that the length of the column and the seat on the end of the column would prevent a user from developing proprioceptors of the lower limbs as intended by the present invention, the Lecal disclosure provides no means to measure the difficulty of rocking and therefore must be considered to be a device for entertaining rather than serious training or rehabilitation.

U.S. Pat. No. 1,565,484 to McWhirter is for an exerciser comprising a threaded rod having one end supported by a "pedesatal" (base) and screwed through the center of a circular table on which a user stands to balance the table. Although the position of the table is adjustable on the threaded rod, there is no way that the user can measure difficulty of balance such as by measuring the position of the table on the rod since the rod is completely hidden from view by a skirt and cup nut.

Of course, the measurement of length is an essential part of many inventions. Measurements of mercury columns are used on thermometers and barometers. U.S. Pat. No. 3,395,917 to Moore discloses measuring the height of a standard as a measure of difficulty in jumping over the standard. However the prior art does not teach the measurement of length as a means of measuring difficulty of balance nor as a means of monitoring progress in performing an exercise intended to improve balance.

Further discussion of PNF training is to be found in PHYSICAL THERAPY FOR SPORTS by Wener Kuprian, published by W. B. Saunders, Phila., Pa., 1982.

THE INVENTION

It is an object of this invention to present a method and apparatus to practice proprioceptive neuromuscular facilitation training.

It is another object that the exercises that can be performed with the apparatus be especially beneficial for the development of the proprioceptors of the lower limbs and spine.

It is another object to provide an apparatus with which the user can quantitatively monitor his progress.

It is another object to provide an apparatus for training the proprioceptors wherein the difficulty of performing the exercises can be controlled and measured.

Another object is to provide a method to rehabilitate persons suffering from injury to the spine and lower limbs that, in many cases, is more effective than methods of the prior art.

SUMMARY

This method and apparatus is directed toward a method of training the proprioceptors by performing exercises using an apparatus that improves ones balancing skills. The apparatus comprises a disk supported at its center by a threaded rod perpendicular to and through the center of the disk and having its lower end on a supporting surface. The user stands on the top disk surface and attempts to balance the disk, i.e., maintain the disk in a horizontal position. Indicia on the side of the rod show the difficulty of balance for a given distance from the center of the disk to the point of contact of the end of the rod with the support surface so that the user can measure and control the difficulty of balancing the disk.

DRAWINGS

FIG. 1 shows in perspective a dissembled view of the disk and threaded rod used to perform the balancing exercises.

FIG. 2 shows a view in cross section of the rod threaded into the center of the disk.

FIG. 3 shows a user standing on the disk and attempting to balance the disk.

FIGS. 4 and 5 show a disk with a force diagram illustrating how lengthening the extension of the rod through the disk increases difficulty of balancing the disk.

FIG. 6 shows a bar substituted for the hemispherical shoe

DISCUSSION OF THE PREFERRED EMBODIMENTS

Figure 7:
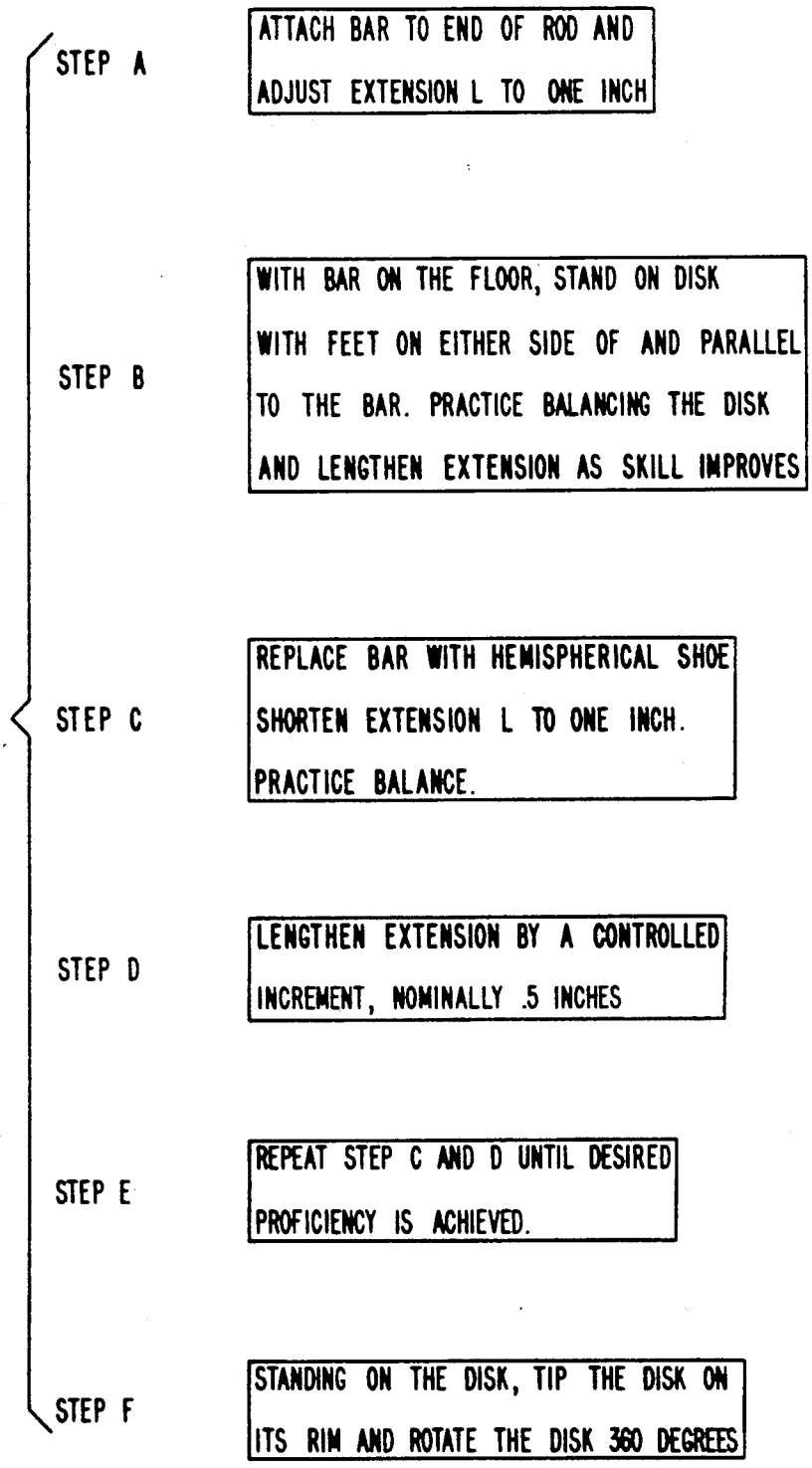
FIG. 7 shows steps of the method of training with the disk

Turning now to a detailed description of the drawings, there is shown in FIG. 1 an expoded perspective view and in FIG. 2 a cross sectional view of the disk 10 and threaded rod 12. The disk is typically fourteen to twenty four inches in diameter. The disk has a hub 16 with a threaded hole 18 in its center. As shown in FIG. 2, the threaded rod 12 may be screwed through the hole and extend a distance L from the support surface 25 to the center of the disk. Indicia 22 on the side of the rod measures the distance, L. A knob 20 on one end of the rod provides a convenient grasp for turning the rod.

The principle for controlling and measuring difficulty of maintaining balance is illustrated in FIGS. 4 and 5. the difficulty of balancing the disk is proportional the distance that a user must shift his weight to restore the disk to a horizontal position from a given angle of tilt, $\theta$. Therefore, in the context of this application, difficulty of balance is defined as the rate of displacement of the center, P, of the disk versus the tilt angle, $\theta$, i.e., Difficulty equals $D/\theta$.

But $D/\theta$ equals L, the length of the extension. by definition.

Therefore, indicia 22 on the side of the rod indicating the distance from the center of the disk, P, to the point of contact of the end of the rod with the supporting surface, 25 is also an indication to the user of the difficulty of maintaining balance of the disk.

To illustrate, the distance L is shown twice as long in FIG. 5 as in FIG. 4. The angle of tilt, $\theta$, is the same in both figures. FIGS. 4 and 5 show D and D' for values L and L', respectively, Where D and D' are the displacements of the center of the disk the equilibrium position where the rod is vertical and illustrate that difficulty of balance is increased as L is increased.

Of course, the user can vary difficulty of balance by turning the rod on its thread.

FIG. 3 shows one simple exercise with the device. The user 26 stands on the disk 10 and attempts to balance the disk, i.e., maintain the disk in a horizontal position. FIG. 3 illustrates that the overall length of the threaded rod is limited to less than eighteen inches but greater than six inches in order that the section of rod have the disk not interfere with the user.

Another exercise includes rocking the disk from side to side and still another is to rock the disk from front to back.

Yet another exercise is to tip the disk so that the rim touches the floor. By shifting his weight, the user attempts to cause the disk to roll on its rim so that the disk and user rotate.

A quantitative measure of progress is to measure the length of time required to rotate the disk completely around on its rim.

As shown in FIG. 1, in order to prevent damage to the supporting surface 25 a hemispherical shoe is screwed onto the supporting end of the threaded rod.

As shown in FIG. 6, a bar 30 having a threaded hole 32 in its center may be screwed into the contacting end of the threaded rod in place of the hemispherical shoe. This restricts the seesaw action to one axis (the bar) thereby reducing the difficulty of balancing for beginning users. Balancing of the disk is performed with the feet perpendicular to the bar and with the feet parallel to the bar thereby focusing the exercise on different ankle extensors and flexors.

Evaluations of the methods and apparatus of this invention have been performed by the Tuthill Athletic Rehabilitation Institute, an organization that has specialized for many years in the rehabilitation of professional athletes recovering from orthopedic injuries. Each of the exercises described above challenges the proprioceptors in a unique manner and thereby provides for well rounded development of the proprioceptors. Performance of these exercises has been found to effect a very fast rate of improvement in proprioceptive capability, particularly in patients recovering from injuries to the lower limbs or spine.

As a result of these observations, a program has been developed whereby a beginning user is presented with an "easy to master" exercise and is then introduced to more difficult exercises as his skill improves.

A typical program is presented as a block diagram in FIG. 7.

Step A—The beginning user adjusts the extension L to a small value, e.g., one inch and screws the bar onto the extended end of the threaded rod 12.

Step B—The user places the disk on the floor and steps onto the disk with his feet on either side and parallel to the bar. He practices balancing the disk until he can maintain balance for 20 seconds. He alternates between balancing the disk with his feet parallel to the bar and perpendicular to the bar lengthens extension as skill improves.

Each practice session should last about four minutes with three minutes rest. A full daily program should last about 40 minutes.

Step C—The user removes the bar and screws the hemispherical shoe onto the extended end of the rod. The distance, L, on the rod is adjusted to about one inch. He places the end of the extension in contact with the floor and steps onto the disk with his feet straddling the rod. He practices balancing the disk in four minute sessions until he can maintain balance for 30 seconds.

Step D—He lengthens the extension by a controlled increment, nominally 0.5 inches and repeats step C.

Step E—He repeats steps C and D until he achieves the desired proficiency.

Step F—As an additional exercise, the user tips the disk so that the rim contacts the floor along one edge. Then by shifting his weight, he causes the disk and user to pivot completely around 360 degrees.

In accordance with the objects of this invention, an apparatus and method of use have been described which develop the proprioceptors and are especially useful as a therapeutic aid to patients recovering from injury to the spine and lower limbs. The apparatus provides that difficulty in performing exercises with the apparatus can be varied and measured in order to monitor improvement. Variations to embodiments discussed in this specification may occur to one after reading the descriptions and studying the drawings. I therefore wish the scope of my invention to be defined by the appended claim and in view of the specification if need be.

I claim:

1. An apparatus for training balancing skills of a user which comprises:

a disk with a threaded hole in its center and having a top side;

a rod having a length in the range from six to eighteen inches and a surface, at least a substantial part of which is threaded providing that said rod may be screwed into said threaded hole thereby permitting said user to position an end of said rod on a support surface at a distance from said threaded hole in said disk, stand on said top side and attempt to balance said disk;

indicia printed on said rod surface indicating said distance and thereby indicating difficulty of balancing said disk for any given said distance.

2. An apparatus as in claim 1 which further comprises a hemisphere having a flat surface and a threaded hole in said flat surface into which said end of said rod may be screwed.

3. An apparatus as in claim 1 which further comprises a bar having two ends with a threaded hole intermediate said ends into which said end of said threaded rod may be screwed.

4. A method for developing balancing skill of a uwer using a disk having a threaded hole in its center, a threaded rod having an elongated side and screwed through the threaded hole, indicia on said elongated side indicating difficulty of balance as a function of position of the rod in the threaded hole, a bar having ends with a threaded hole intermediate said hole and a hemisphere having a flat surface with a threaded hole in said flat surface, which method includes the steps:

(a) screwing on end of said rod into said bar;

(b) positioning said rod in said center hole in close proximity to said disk;

(c) placing said bar at a point of contact on a support surface;

(d) having said user place his feet on said disk straddling said bar and practicing to maintain said disk in a horizontal position by standing and balancing himself on said disk;

(e) extending said rod in threaded hole by a predetermined distance between said center of said disk and said point of contact as indicated by said indicia;

(f) repeating steps (c), (d) and (e) until mastering the desired degree of difficulty of balance is achieved as indicated by said indicia;

(g) repeating steps (b) through (f) but with feet of said user perpendicular to said bar;

(h) replacing said bar with said hemisphere;

(i) repeating steps (b) through (e).

* * * * *